US008107840B2

(12) United States Patent
Niijima

(10) Patent No.: US 8,107,840 B2
(45) Date of Patent: Jan. 31, 2012

(54) IMAGE FORMING APPARATUS

(75) Inventor: Yoshio Niijima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/213,771

(22) Filed: Jun. 24, 2008

(65) Prior Publication Data

US 2008/0317482 A1 Dec. 25, 2008

(30) Foreign Application Priority Data

Jun. 25, 2007 (JP) ..... 2007-165865

(51) Int. Cl.
*G03G 15/06* (2006.01)

(52) U.S. Cl. ..... 399/55

(58) Field of Classification Search ..... 399/27, 399/55, 235, 240

See application file for complete search history.

(56) References Cited

U.S. PATENT DOCUMENTS

| | | | | |
|---|---|---|---|---|
| 4,952,976 | A * | 8/1990 | Katoh et al. | 399/27 |
| 5,655,197 | A * | 8/1997 | Okada et al. | 399/281 |
| 5,812,918 | A * | 9/1998 | Nakaue et al. | 399/284 |
| 5,822,647 | A * | 10/1998 | Sakuraba et al. | 399/27 |
| 2002/0122673 | A1 * | 9/2002 | Sakai et al. | 399/27 |
| 2005/0036796 | A1 * | 2/2005 | Burchette et al. | 399/27 |
| 2005/0260007 | A1 * | 11/2005 | Shimomura | 399/55 |

FOREIGN PATENT DOCUMENTS

| | | |
|---|---|---|
| JP | 07-005765 | 1/1995 |
| JP | H9-54488 | 2/1997 |
| JP | 09-080992 | 3/1997 |
| JP | 2003-280341 | 10/2003 |
| JP | 2007-127721 | 5/2007 |

* cited by examiner

*Primary Examiner* — David Gray
*Assistant Examiner* — Barnabas Fekete
(74) *Attorney, Agent, or Firm* — Rabin & Berdo, P.C.

(57) ABSTRACT

A supplying roller supplies toner to a developing roller which develops an electrostatic latent image formed on a photoconductive drum. The controller controls a power supply to output a first voltage to the developing roller and a second voltage to the supplying roller. A detector generates a detection signal indicative of the remaining amount of toner. The voltage controller performs voltage correction according to the detection signal either in a first mode or a second mode. In the first mode, the first voltage has a smaller value when the detection signal falls below a reference value than when the detection signal is above the reference value. In the second mode, the first voltage has a smaller value when the detection signal falls below the reference value than when the detection signal is above the reference value (as in the first mode), and also the difference between the first and second voltages has a larger value when the detection signal falls below the reference value than when the detection signal is above the reference value.

27 Claims, 13 Drawing Sheets

IMAGE FORMING APPARATUS

BACKGROUND OF THE INVENTION

1. Field of the Invention

The present invention relates to image forming apparatuses including electrophotographic printers and copying machines.

2. Description of the Related Art

A conventional electrophotographic image forming apparatus performs processes of charging, exposing, developing, transferring, and fixing in sequence to print an image on a print medium. A charging unit charges the surface of a photoconductive drum uniformly. An exposing head illuminates the charged surface of the photoconductive drum in accordance with print data to form an electrostatic latent image. A developing unit supplies toner to the electrostatic latent image to develop the electrostatic latent image into a toner image. A transfer unit transfers the toner image onto the print medium. The print medium advances into a fixing unit where the toner image is fused into a permanent image. Some conventional electrophotographic image forming apparatuses include an indicator that indicates a remaining amount of toner in the toner reservoir. The indicator indicates to a user that the toner reservoir is reaching its empty state, thereby prompting the user to replenish the tone.

Printing may still be performed even when the toner is nearing exhaustion. Therefore, it is common that the user continues to print. However, continuing to print with the remaining toner nearing exhaustion may cause vague images, resulting in poor image quality.

SUMMARY OF THE INVENTION

The present invention was made in view of the aforementioned drawbacks of conventional printers.

An object of the invention is to provide an image forming unit that prevents vague images even when the remaining toner is nearing exhaustion.

An object of the invention is to provide an image forming unit in which developer material is efficiently supplied to the electrostatic latent image on a photoconductive drum.

An image forming apparatus includes an exposing section, a developing member, a supplying member, a voltage supply, a controller, and a detector. The exposing section illuminates a surface of a charged image bearing body to form dots that form an electrostatic latent image of a print job. The developing member extends parallel to the image bearing body, the developing member developing the electrostatic latent image. The supplying member supplies a developer material to the developing member from a developer material reservoir. The voltage supply applies a first voltage to the developing member and a second voltage to the supplying member. The controller controls the voltage supply to output the first voltage and the second voltage. The detector generates a detection signal indicative of an amount of the developer material remaining in a developer material reservoir. The voltage controller performs voltage correction in which the voltage supply outputs the first voltage and the second voltage either in a first mode or in a second mode in accordance with the detection signal. The first mode is such that the first voltage has a smaller absolute value when the detection signal falls below a reference value than when the detection signal is above the reference value. The second mode is such that the first voltage has a smaller absolute value when the detection signal falls below the reference value than when the detection signal is above the reference value (as in the first mode), and also such that the difference between the first voltage and the second voltage has a larger absolute value when the detection signal falls below the reference value than when the detection signal is above the reference value.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
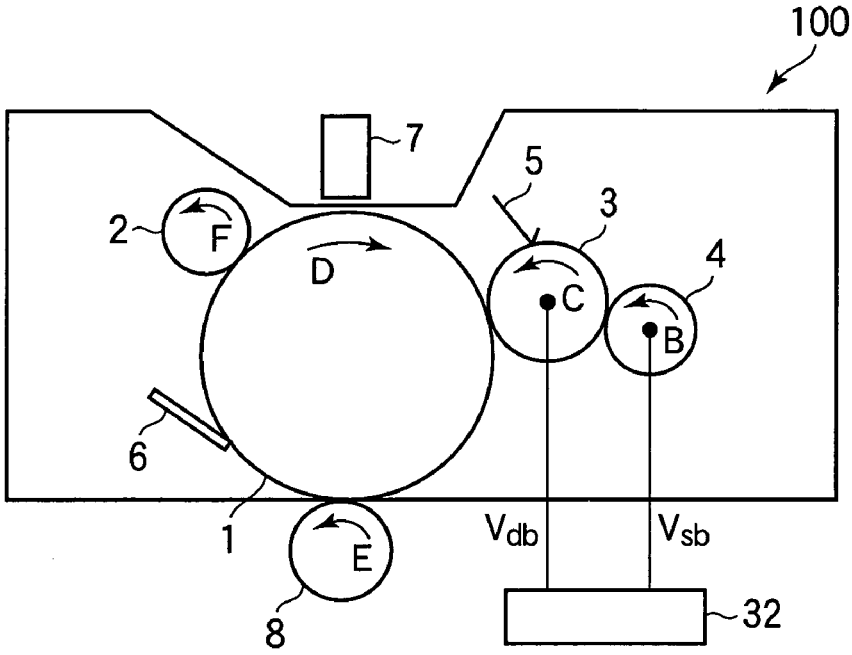
FIG. 1 illustrates a general configuration of a print cartridge.

FIG. 1 illustrates a general configuration of a print cartridge 100 for an image forming apparatus of a first embodiment and the vicinity of the print cartridge 100.

Referring to FIG. 1, the print cartridge 100 includes a photoconductive drum 1, a charging roller 2, a developing roller 3, a supplying roller 4, a developing blade 5, a cleaning blade 6. The charging roller 2, an exposing head 7, and the developing roller 3 are disposed around the photoconductive drum 1 from upstream to downstream with respect to rotation of the photoconductive drum 1. The photoconductive drum 1 rotates in a direction shown by arrow D. The charging roller 2 rotates in contact with the photoconductive drum 1 in a direction shown by arrow F, thereby charging the surface of the photoconductive drum 1. The exposing head 7 illuminates the charged surface of the photoconductive drum 1 to form an electrostatic latent image on the photoconductive drum 1. The developing roller 3 rotates in contact with the photoconductive drum 1 in a direction shown by arrow C, and supplies toner 12 (FIG. 2) to the electrostatic latent image formed on the photoconductive drum 1, thereby forming a toner image.

A transfer roller 8 is disposed downstream of the developing roller 3. The transfer roller 8 rotates in a direction shown by arrow E with a print medium sandwiched between the transfer roller 8 and the photoconductive drum 1, thereby advancing the print medium toward a fixing unit (not shown). As the print medium passes through a transfer point defined between the transfer roller 8 and the photoconductive drum 1, the toner image formed on the photoconductive drum 1 is transferred onto the print medium. Some of the toner 12 may remain on the photoconductive drum 1 after transfer of the toner image. The toner 12 remaining on the photoconductive drum 1 is scraped off by a cleaning blade 6 of a cleaning unit disposed downstream of the transfer roller 8.

The photoconductive drum 1 is an organic photoconductive drum that includes an electrically conductive core and a photoconductive layer that covers the core. The electrically conductive core is a hollow cylinder of, for example, aluminum. The photoconductive layer is a two layer stacked structure, which includes a charge generation layer and a charge transport layer. The charging roller 2 includes a metal shaft covered with a layer of a semi-conductive rubber. The exposing head 7 includes a light source such as LEDs or a laser that emits a plurality of dots of light in accordance with image data. The developing roller 3 includes a metal shaft covered with a semi-conductive rubber such as urethane rubber. A supplying roller 4 includes a metal shaft covered with, for example, a foamed urethane rubber. A developing blade 5 is a thin belt-shaped resilient member having a thickness of 0.08 mm, and extends in a longitudinal direction across the entire length of the developing roller 3. The developing blade has one widthwise end portion secured to a frame (not shown) and another widthwise end portion bent at an acute angle. The bent end portion is in pressure contact with the developing roller 3.

{Toner Detector}

Figure 2:
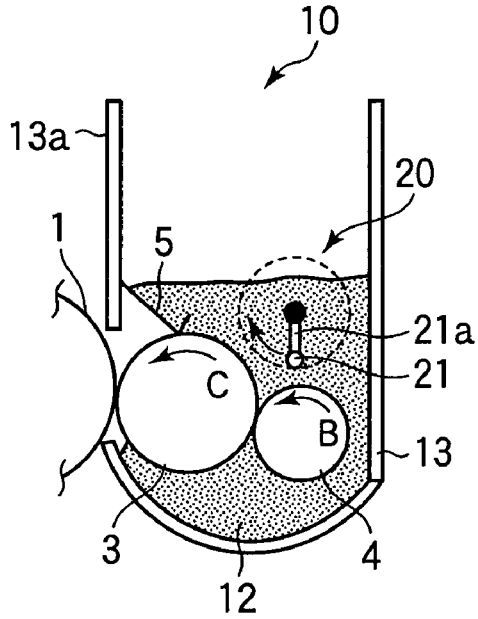
FIG. 2 illustrates the general configuration of a pertinent portion of a toner reservoir of the print cartridge.

FIG. 2 illustrates the general configuration of a pertinent portion of a toner reservoir 10 of the print cartridge 100. Referring to FIG. 2, the toner reservoir 10 includes a toner holding space 13, the developing roller 3, the supplying roller 4, the developing blade 5, and a toner detector 20.

Figure 3A:
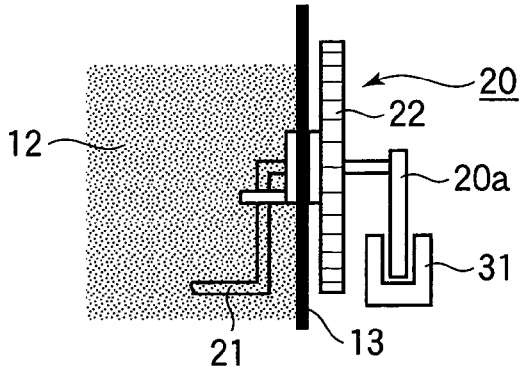
FIG. 3A is a side view of a toner detector.
Figure 3B:
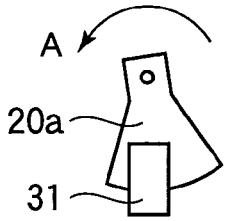
FIG. 3B is a front view of an interrupter and a sensor.
Figure 3C:
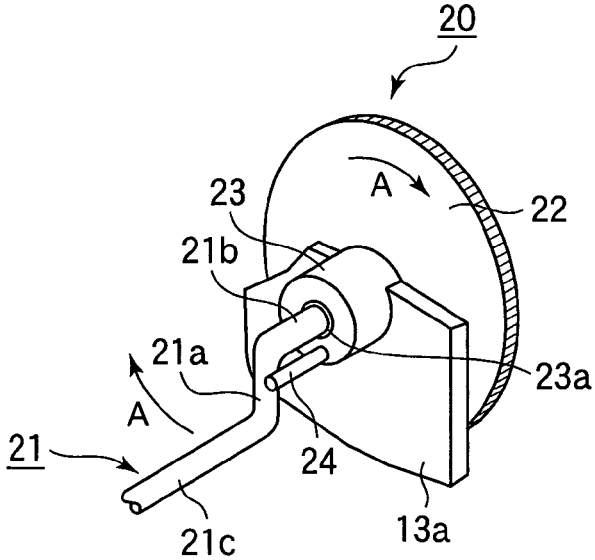
FIG. 3C is a perspective view illustrating a pertinent portion of the toner detector.

FIG. 3A is a side view of a toner detector 20. FIG. 3B is a front view of an interrupter 20 a and a sensor 31. FIG. 3C is a perspective view illustrating a pertinent portion of the toner detector 20. Referring to FIGS. 3A and 3B, the sensor 31 includes a light emitting element and a light receiving element (not shown). When the gear 22 rotates, the interrupter 20*a* rotates together with the gear 22. When the interrupter 20*a* enters a space between the light emitting element and light receiving element, the interrupter 20*a* interrupts the light path from the light emitting element to the light receiving element. When the interrupter 20*a* exits the space, the interrupter 20*a* does not interrupt the light path. As the gear 22 rotates, the interrupter 20*a* repeatedly enters and exits the space.

Referring to FIG. 3C, a drive gear 22 is driven by a drive source (not shown) to drive a shaft 23 in rotation. A detection bar 21 is in the shape of a "crank." The sensor 31 detects the detection bar 21 when the detection bar 21 is within a specific range of rotation. The shaft 23 of the gear 22 is rotatably supported by a side wall 13*a*, and rotates at a constant speed. The shaft 23 includes a hole 23*a* into which one end portion of a crank shaft 21*b* of the detection bar 21 loosely extends such that the shaft 23 is rotatable relative to the shaft 23. Another end portion of the detection bar 21 is also rotatably supported by another side wall (not shown). In other words, the detection bar 21 is in line with the shaft 23 of the gear 22 and is rotatable relative to the shaft 23.

The shaft 23 includes a projection 24 that projects from the shaft 23 in a direction substantially parallel to an axis about which the detection bar 21 rotates. When the gear 22 is driven to rotate in a direction shown by arrow A, the projection 24 abuts a crank arm 21*a* such that the detection bar 21 also rotates in the A direction.

Figure 4:
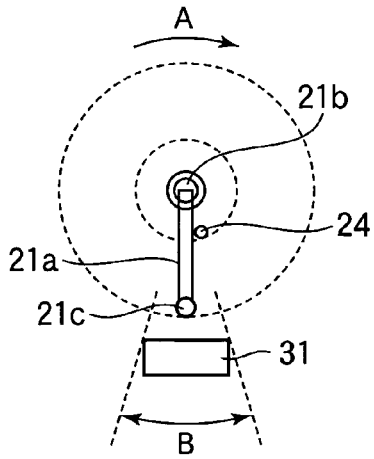
FIG. 4 illustrates a rotational path in which a crank pin rotates.

FIG. 4 illustrates a rotational path in which a crank pin 21*c* rotates. The toner detector 20 includes the sensor 31 that detects the crank pin 21*c* when the crank pin 21*c* is in a detection region B. The sensor 31 is located outside of the toner holding space 13. The sensor 31 takes the form of a photo-interrupter. When the detection bar 21 rotates, a shielding plate (not shown) moves together with the detection bar 21 to pass by the sensor 31. When the detection bar 21 is within the region B, the sensor 31 goes off ("L"). When the detection bar 21 is out of the region B, the sensor 31 goes on ("H"). The output of the sensor 31 is a detection signal DETR and is sent to a controller 31 (FIG. 5).

Figure 5:
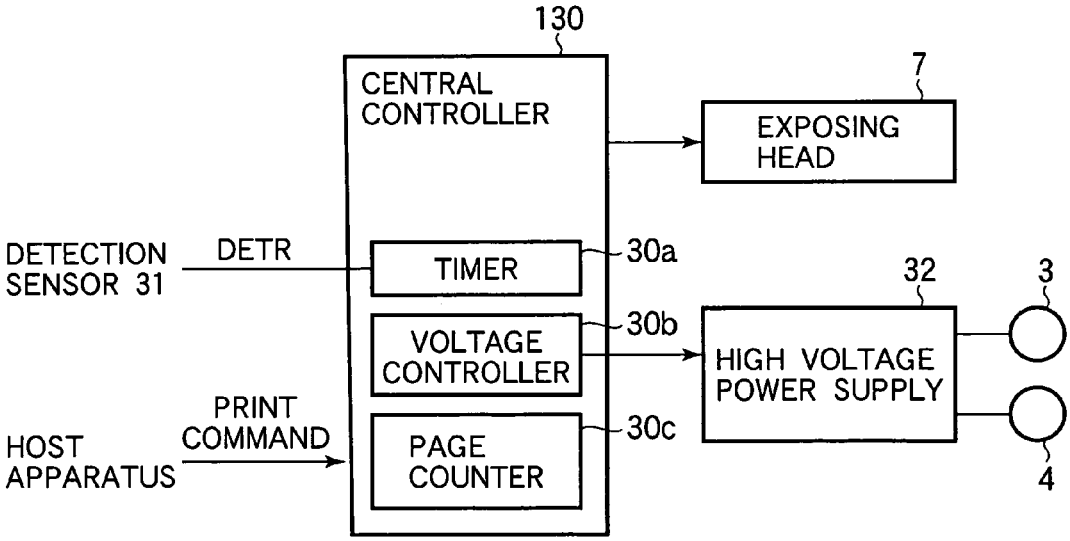
FIG. 5 is a block-diagram illustrating a pertinent portion of a control system that controls the operation of an image forming apparatus.

FIG. 5 is a block diagram illustrating a pertinent portion of a control system that controls the operation of the image forming apparatus. The control system will be described with reference to FIG. 5.

The central controller 130 includes a timer 30*a*, a voltage controller 30*b*, and a page counter 30*c*. The timer 30*a* receives the detection signal DETR and determines a remaining amount of toner 12 in terms of the duty ratio of the detection signal DETR. The voltage controller 30*b* controls the high negative voltages applied to the developing roller 3 and the supplying roller 4. The page counter 30*c* starts to count the number of printed pages from when the amount of toner in the reservoir decreases below a certain level (i.e., toner-low status). Once the page counter has started to count, it continues to count until the toner low status is eliminated.

The Upon receiving image data and a control command from a host apparatus, the central controller 130 controls the sequence of overall operation of the apparatus, which will be described later in detail. A high voltage power supply 32 outputs the high voltages to the developing roller 3 and the supplying roller 4.

The operation of the image forming apparatus of the aforementioned configuration will be described. The charging roller 2 charges the surface of the photoconductive drum 1 to a desired potential and a polarity. A write controller (not shown) provides image data to the exposing head 7. The exposing head 7 illuminates the uniformly charged surface of the photoconductive drum 1 in accordance with the image data to form a corresponding electrostatic latent image.

The supplying roller 4 rotates in contact with the developing roller 3 in a direction shown by arrow B (FIG. 1), thereby supplying the toner 12 to the developing roller 3. The toner 12 on the developing roller 3 is triboelectrically charged due to the friction between the developing roller 3 and the supplying roller 4. The developing blade 5 is in pressure contact with the developing roller 3 to form a thin layer of toner on the developing roller 3. The thickness of the toner layer is determined primarily by the pressure applied to the toner 12 by the developing blade 5. A high voltage is applied to the developing roller 3. The developing roller 3 rotates in contact with the photoconductive drum 1 so that the toner 12 is supplied to the electrostatic latent image. As the photoconductive drum 1 rotates further, the toner image is transferred onto the print medium. The print medium is then fed into the fixing unit where the toner image is fixed into a permanent image. The toner 12 remaining on the photoconductive drum 1 after transfer is removed by the cleaning blade 6.

FIGS. 6A-6D and 7A-7D illustrate the operation of the toner detector 20. The operation for detecting a remaining amount of toner 12 will be described with reference to FIGS. 6A-6D and 7A-7D. For simplicity, FIGS. 6A-6D and 7A-7D show only the detection bar 21, projection 24, sensor 31, and toner 12.

Figures 6A, 6B, 6C, 6D:
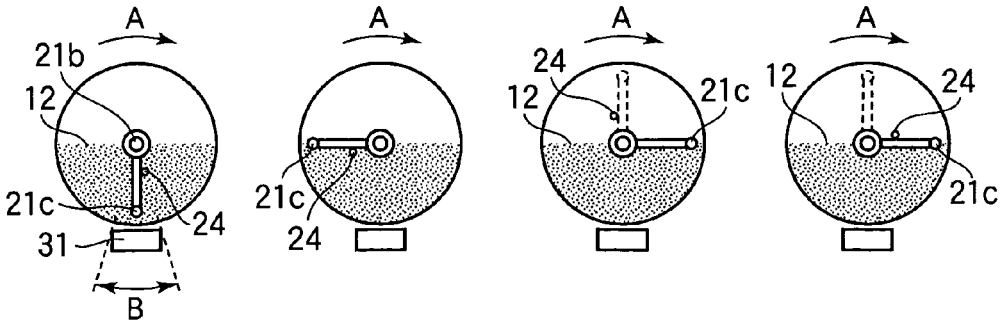
FIGS. 6A-6D illustrate toner when it occupies a half the capacity of a toner holding space.

FIGS. 6A-6D illustrate the toner 12 when it occupies a half the capacity of the toner holding space 13 (i.e., toner-high status) such that the top surface of the toner 12 is substantially flush with the crank shaft 21*b*. When the crank pin 21*c* is substantially immediately below the crank shaft 21*b* (Bottom Dead Center, BDC) as shown in FIG. 6A, the detection bar 21 is pushed by the projection 24 so that the detection bar 21 rotates in the A direction. The sensor 31 outputs a detection signal of "L" when the crank pin 21*c* is within the range B.

The projection 24 rotates at a constant speed in the A direction. As the detection bar 21 further rotates in the A direction, the crank pin 21*c* appears outside of the toner 12 and is flush with the top surface of the toner 12 as shown in FIG. 6B. The detection bar 21 further rotates until it reaches a highest position (Top Dead Center, TDC) immediately over the crank shaft 21*b* as shown in FIG. 6C. When the crank pin 21*c* rotates past the highest position, the detection bar 21 rotates freely so that the crank pin 21*c* drops onto the surface of the toner 12 as shown in FIG. 6C.

The crank pin 21*c* stays on the surface of the toner 12 until the projection 24 reaches the crank pin 21*c*. When the projection 24 again pushes the crank pin 21*c* and rotates in the A direction, the crank pin 21*c* moves through the toner 12 to the FIG. 6A position. While the gear 22 continues to rotate at a constant speed, the crank pin 21*c* rotates about the crank shaft 21*b* as described above. While the crank pin 21*c* moves through the region B, the sensor 31 outputs the detection signal of low "L".

Figure 7A:
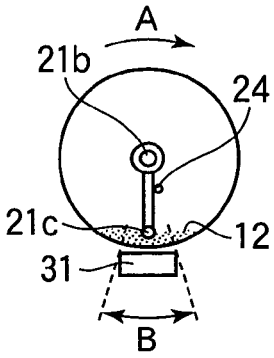
FIGS. 7A-7D illustrate the toner when the toner is nearing exhaustion.
Figure 7B:
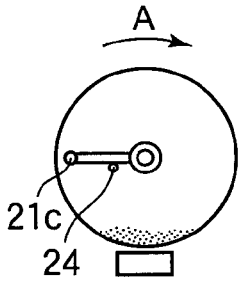

FIGS. 7A-7D illustrate the toner 12 when the toner 12 is nearing exhaustion (i.e., toner-low status). When the crank pin 21*c* is substantially immediately below the crank shaft 21*b* (Bottom Dead Center, BDC) as shown in FIG. 7A, the detection bar 21 is pushed by the projection 24 so that the detection bar 21 rotates in the A direction. The sensor 31 outputs a detection signal of low "L" when the crank pin 21*c* is within the range B.

Figure 7C:
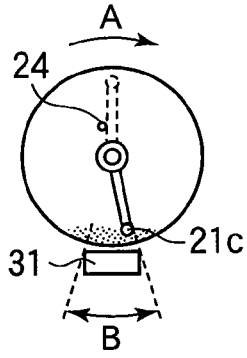
Figure 7D:
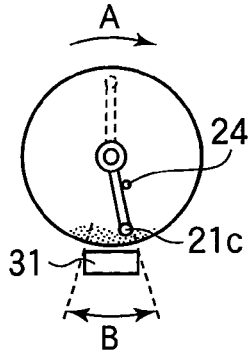

The projection 24 rotates at the constant speed in the A direction. As the projection 24 further rotates in the A direction, the crank pin 21*c* rotates past the FIG. 7B position until it reaches the highest position (TDC) immediately over the crank shaft 21*b* as shown by dotted lines in FIG. 7C. When the crank pin 21*c* rotates past the highest position, the detection bar 21 rotates freely so that the crank pin 21*c* drops onto the surface of the toner 12 as shown in FIG. 7C where the crank pin 21*c* is within the region B. The crank pin 21*c* stays in the region B until the projection 24 reaches the crank pin 21*c*. Thus, the detection signal DETR remains low for a longer period when a small amount of the toner 12 remains in the toner holding space 13 as shown in FIG. 7C than when a large amount of toner remains in the toner holding space 13 as shown in FIG. 6C. When the projection 24 again pushes the crank pin 21*c* and rotates in the A direction, the crank pin 21*c* moves through the toner 12 to the FIG. 7A position. While the gear 22 continues to rotate at the constant speed, the crank pin 21*c* rotates about the crank shaft 21*b* as described above. While the crank pin 21*c* moves in the region B, the sensor 31 outputs the detection signal of low level "L".

When the projection 24 again pushes the crank pin 21*c* and rotates in the A direction, the crank pin 21*c* moves through the toner 12 to the FIG. 7A position. The sensor 31 continues to output the detection signal of low, i.e., "L" until the projection 24 reaches the crank pin 21*c* and pushes the crank pin 21*c* out of the region B.

As described above, the sensor 31 outputs the detection signal DETR of high level ("H") from when the crank pin 21*c* has moved out of the region B until the crank pin 21*c* moves into the region B. The sensor outputs the detection signal DETR of low level ("L") while the crank pin 21*c* remains within the region B. The ratio of the duration of high level ("H") to the duration of low level ("L") is clearly different for the toner-low status and the toner-high status.

Figure 8A:
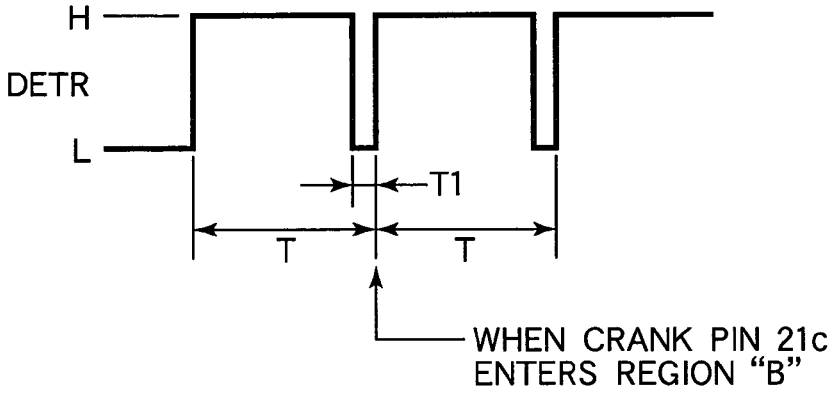
FIG. 8A illustrates the waveform of the detection signal DETR when a relatively large amount of toner remains in the toner holding space.
Figure 8B:
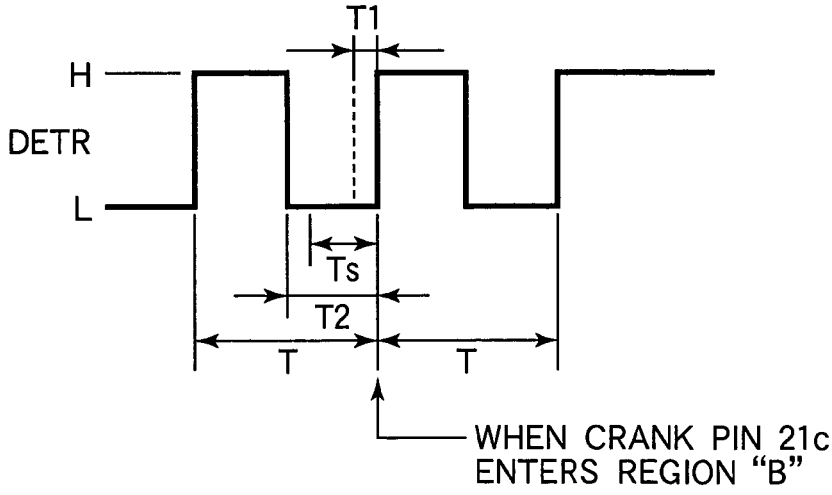
FIG. 8B illustrates the waveform of the detection signal DETR when only a small amount of toner remains in the toner holding space.

FIG. 8A illustrates the waveform of the detection signal DETR when a relatively large amount of toner 12 remains in the toner holding space 13. FIG. 8B illustrates the waveform of the detection signal DETR when only a small amount of toner 12 remains in the toner holding space 13.

A period T denotes a time required for the gear 22 to make one complete rotation. When a relatively large amount of the toner 12 remains in the toner holding space 13 as shown in FIG. 6A, the duration T1 is the time required for the crank pin 21*c* passes through the region B while being pushed by the projection 24. When only a small amount of the toner 12 remains in the toner holding space 13 as shown in FIG. 7A, the duration T2 is the time from when the crank pin 21*c* rotates past the FIG. 7C position until the crank pin 21*c* is pushed by the projection 24 to move out of the region B. The durations T1 and T2 are related such that T2>>T1.

Upon receiving the detection signal DETR from the sensor 31, the timer 30*a* (FIG. 5) compares the duration of low level of the detection signal DETR with a predetermined reference time Ts. If the duration of low level of the detection signal DETR is larger than the reference time Ts, it is determined that a smaller amount of toner 12 remains in the toner holding space 13.

{Printing}

As long as the high voltages are applied to the developing roller 3 and the developing roller 3 rotates before an electrostatic latent image reaches the developing roller 3, the toner 12 continues to be charged while waiting for the electrostatic latent image reaches the developing roller 3. As a result, the print density of a printed image is higher for the first one complete rotation of the developing roller 3 than for the second one complete rotation and onward. Therefore, when the remaining amount of toner is low, the printed image may be vague for the second complete rotation of the developing roller 3 and onward if printing is performed at high density. The term "vague image" refers to a printed image having white portions where toner 12 is not sufficiently deposited.

Figure 9:
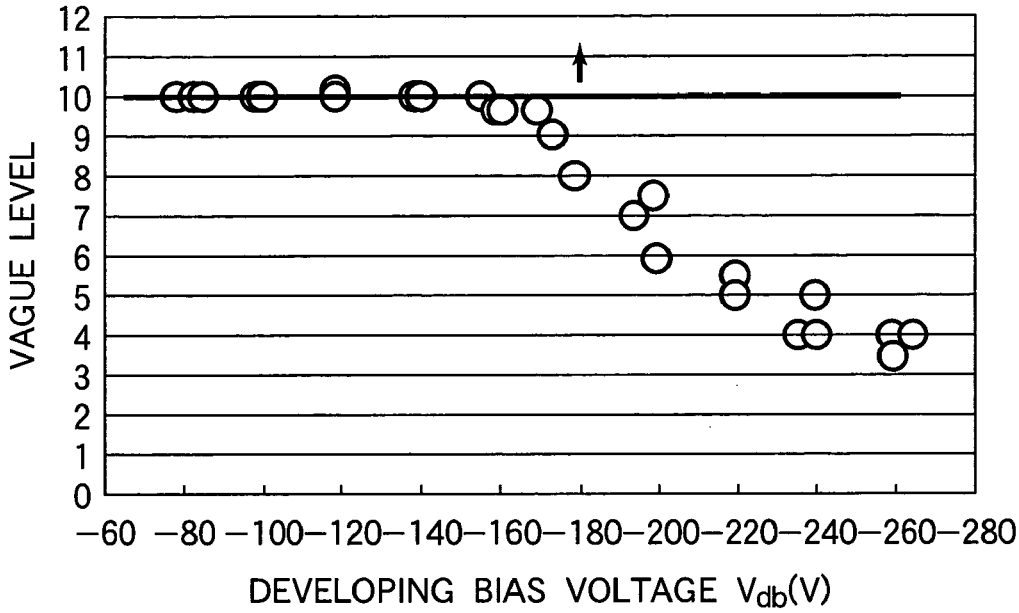
FIG. 9 illustrates the relationship between the vagueness level of printed image and the developing bias voltage Vdb applied to a developing roller.

FIG. 9 illustrates the relationship between the vagueness level of printed image and the developing bias voltage Vdb applied to the developing roller 3. The term "vagueness level" refers to the degree of vagueness in the image and is expressed in 10 different levels when solid printing is performed with a mono color toner on the entire printable area of a page of print paper. The higher the vagueness level is in FIG. 9, the clearer the image is (i.e., less vague). That is, the "vagueness level" as used herein is inversely related to the vagueness in the printed image itself. The bias voltages applied to the supplying roller 3 and developing roller 4 are negative voltages in the first embodiment. Thus, if the absolute value of a voltage is large, the voltage is "high." If the absolute value of a voltage is small, the voltage is "low."

Experiment was conducted under the following conditions.

Remaining amount of toner: Toner is replenished such that the remaining amount of toner is always about 10% of the total capacity of the toner holding space 13.

Supply bias voltage Vsb for the supplying roller 4: Vsb is maintained such that Vsb=Vdb−70.

Printing: Solid printing is performed on two pages of A4 size paper.

A developing voltage Vdb having a low value is effective in preventing the toner 12 from being excessively charged, so that an electrostatic latent image is developed with a small amount of toner 12. Therefore, a lower voltage Vdb effectively reduces the amount of toner consumed for developing an electrostatic latent image in solid printing, especially for the first one complete rotation of the developing roller 3. By saving the amount of toner on the developing roller 3 in this manner, the remaining but still sufficient amount of toner on the developing roller 3 may be used for printing on the rest of the printable area on the print paper after the first one complete rotation. In other words, the supply of toner from the developing roller 3 to the photoconductive drum 1 is leveled out. Referring to FIG. 9, the vagueness level is "8", for the developing bias voltage of −180 V, and vagueness level is "10" i.e., no vague image results for the Vdb not higher than −160 V.

The voltage difference Vdif(=Vdb−Vsb) is related to the amount of toner 12 supplied to the photoconductive drum 1 per unit time.

Figure 10:
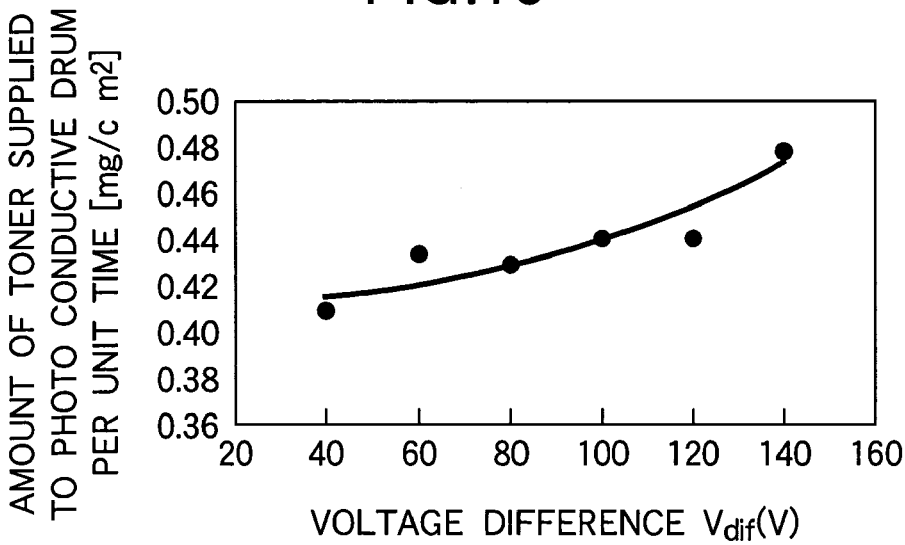
FIG. 10 illustrates the relationship between the Vdif and the amount of toner supplied to a photoconductive drum per unit time.

FIG. 10 illustrates the relationship between the Vdif and the amount of toner 12 supplied to the photoconductive drum 1 per unit time. The amount of toner supplied to the photoconductive drum 1 increases with the Vdif. The supplying bias voltage Vsb is usually higher than the developing bias voltage Vdb. For example, Vdb is −180 V, Vsb is −250 V, and Vdif(=Vdb−Vsb) is 70 V.

As described above, vague images may be prevented by lowering the developing bias voltage Vdb. In addition, increasing the Vdif effectively increases the amount of toner supplied to the photoconductive drum 1 after the first one complete rotation, thereby preventing shortage of toner supplied to the photoconductive drum after the first one complete rotation. In other words, decreasing the Vdb works in synergy with increasing Vdif to level out the supply of toner to the photoconductive drum 1, thereby preventing vague images which would otherwise appear after the first one complete rotation of the developing roller 3. For example, for the same Vsb=−250 V, changing the voltages Vdb from −180 V to −150 V causes the Vdif (=Vdb−Vsb) to increase from 70 V to 100 V, thereby preventing vague images.

Of course, vague images will appear after the first one complete rotation of developing roller if too large a difference voltage Vdif is selected. Therefore, the Vdif should be selected such that the amount of toner increased by increasing the Vdif does not exceed the amount of toner saved during the first one complete rotation of the developing roller 3.

Figure 11:
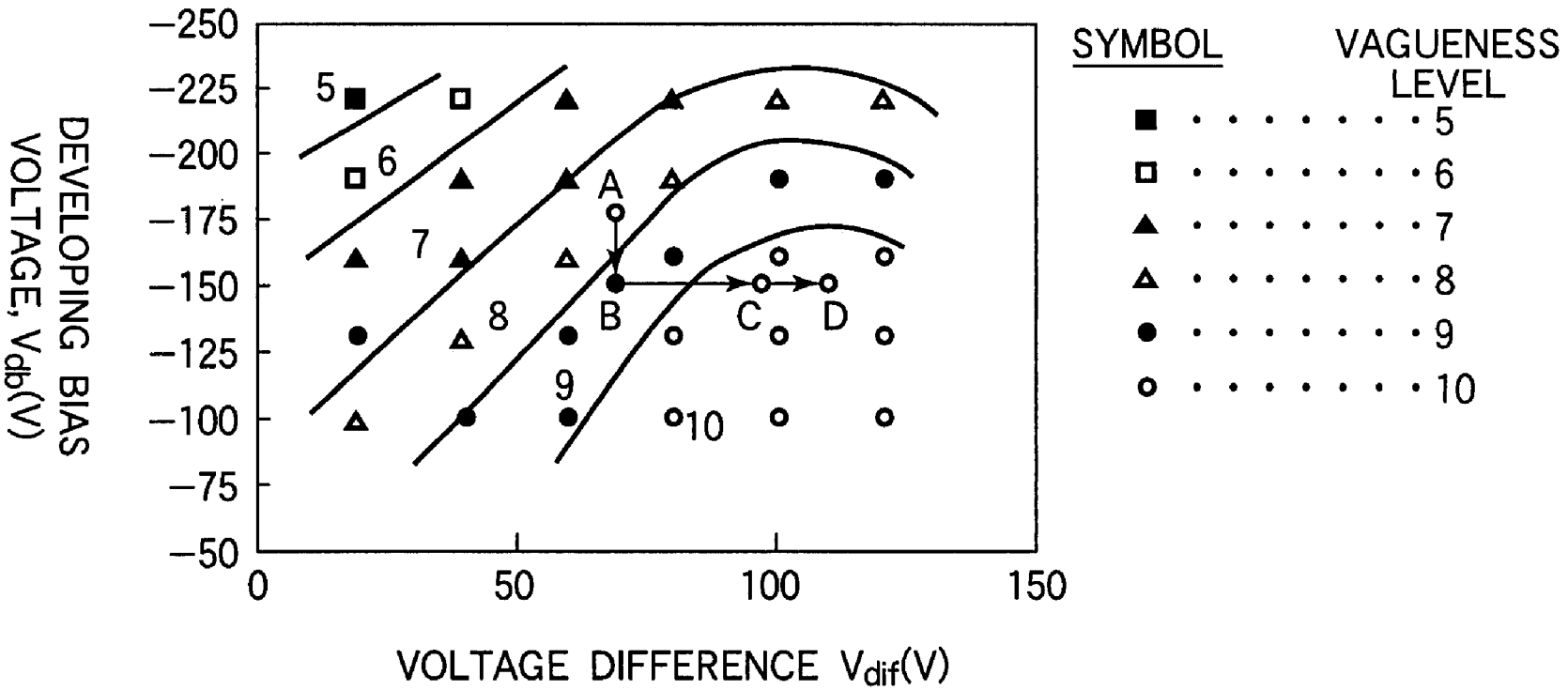
FIG. 11 illustrates the distribution of vague images as a function of the Vdb and Vdif.

FIG. 11 illustrates the distribution of vague images as a function of the Vdb and Vdif. The relationship among the Vdb, Vsb, and the occurrence of vague image will be described with reference to FIG. 11. Referring to FIG. 11, curves indicate boundaries of vagueness levels and numerals in the range of 5 to 10 represent vagueness levels.

{Ability of Vdb to Minimize Vague Images}

Lowering the Vdb while maintaining the same Vdif implies that the vagueness level moves from, for example, point A to point B in FIG. 11, and that the Vsb is changed accordingly to maintain the same Vdif. Table 1 shows an example of vagueness levels before lowering the Vdb and after lowering the Vdb.

TABLE 1

| Vdb, Vdif, Vagueness level | Before (Point A) | After (Point B) |
|---|---|---|
| Vdb | −180 V | −150 V |
| Vdif | 70 V | 70 V |
| Vagueness level | 8 | 9 |

Referring to Table 1, changing the Vdb alone improves the vagueness level from 8 to 9. This indicates that changing the Vdb alone is effective in minimizing vague images. This implies that limiting the amount of toner supplied from the developing roller 3 to the photoconductive drum 1 decreases the chance of vague images appearing or retards the occurrence of vague images.

However, it should be noted that changing the developing bias voltage Vdb alone has only a limited effect on the improvement of vagueness level. For example, if the Vdif is 40 V before the Vdb is changed, the vagueness level may not be improved to better than "9." This indicates that the amount of toner supplied from the supplying roller 4 to the developing roller 3 may be effective to some extent in retarding the occurrence of a vague image, but the vagueness level may not be improved any better than a certain limit if the amount of toner supplied from the supplying roller 4 to the developing roller 3 is small.

{The Ability of Vdb and Vdif to Minimize Vague Images}

Vague images may also be minimized by changing both the developing bias voltage Vdb and the difference voltage Vdif. This is equivalent to a case in which the vagueness level moves from point A to point C, and further to point D in FIG. 11. Table 2 shows the vagueness levels before and after changing the Vdb and Vdif.

TABLE 2

| Vdb, Vdif, Vagueness level | Before (Point A) | After (Point D) |
|---|---|---|
| Vdb | −180 V | −150 V |
| Vdif | 70 V | 110 V |
| Vagueness level | 8 | 10 |

Referring to Table 2, changing both the Vdb and Vdif clearly improves the vagueness level from 8 to 10, indicating that changing both the Vdb and Vdif is effective in minimizing vague images.

This is due to the fact that the amount of toner supplied from the developing roller 3 to the photoconductive drum 1 is conveniently controlled not to cause toner shortage in the middle of printing, and that the amount of toner supplied from the supplying roller 4 to the developing roller 3 is increased.

As described above, even when changing the Vdb alone is unable to improve the vague images any better than a certain limit, changing the Vdif is effective in further minimizing the vague images. In other words, vague images are more difficult to occur if both Vdb and Vdif are changed.

Of course, vague images may occur if the Vdb is decreased but the Vdif is increased such that the resultant amount of toner supplied to the photoconductive drum 1 exceeds the amount of toner saved by decreasing the Vdb. This is equivalent to a case in which the vagueness level moves from point D toward a point where the Vdif becomes large, i.e., from a region in which the vague level is 10 into a region in which the vague level is 9. This is true since the boundary between the region in which the vagueness level is "10" and the boundary in which the vague level is "9" is concave down with a maximum at around Vdif=110 V.

Printing on a page of print paper has been described in terms of a method in which when the toner reservoir 10 is in the toner-low status, a vague image is prevented in an image area developed by the first one complete rotation of the developing roller 3 and in an image area developed by the second complete rotation and subsequent rotations of the developing roller 3. During continuous printing, the developing roller 3 may rotate with the high voltage applied thereto and without supplying toner to the photoconductive drum 1, not only shortly after printing is initiated but also between successive pages. Therefore, the above-described method of controlling the Vdb and Vdif is useful in continuous printing.

As described above, when the amount of toner remaining in the toner holding space 13 is below a certain level, the Vdb and Vdif are changed by a certain amount, thereby preventing vague images. However, if printing is performed further, the remaining toner will be eventually exhausted causing vague images. In the first embodiment, the page counter 30*c* starts to count the number of pages from when the amount of toner in the reservoir decreases below a certain level. When the page counter 30*c* has counted up to a predetermined count, printing is prohibited. In this manner, printing may be stopped before a vague image appears.

Figure 12:
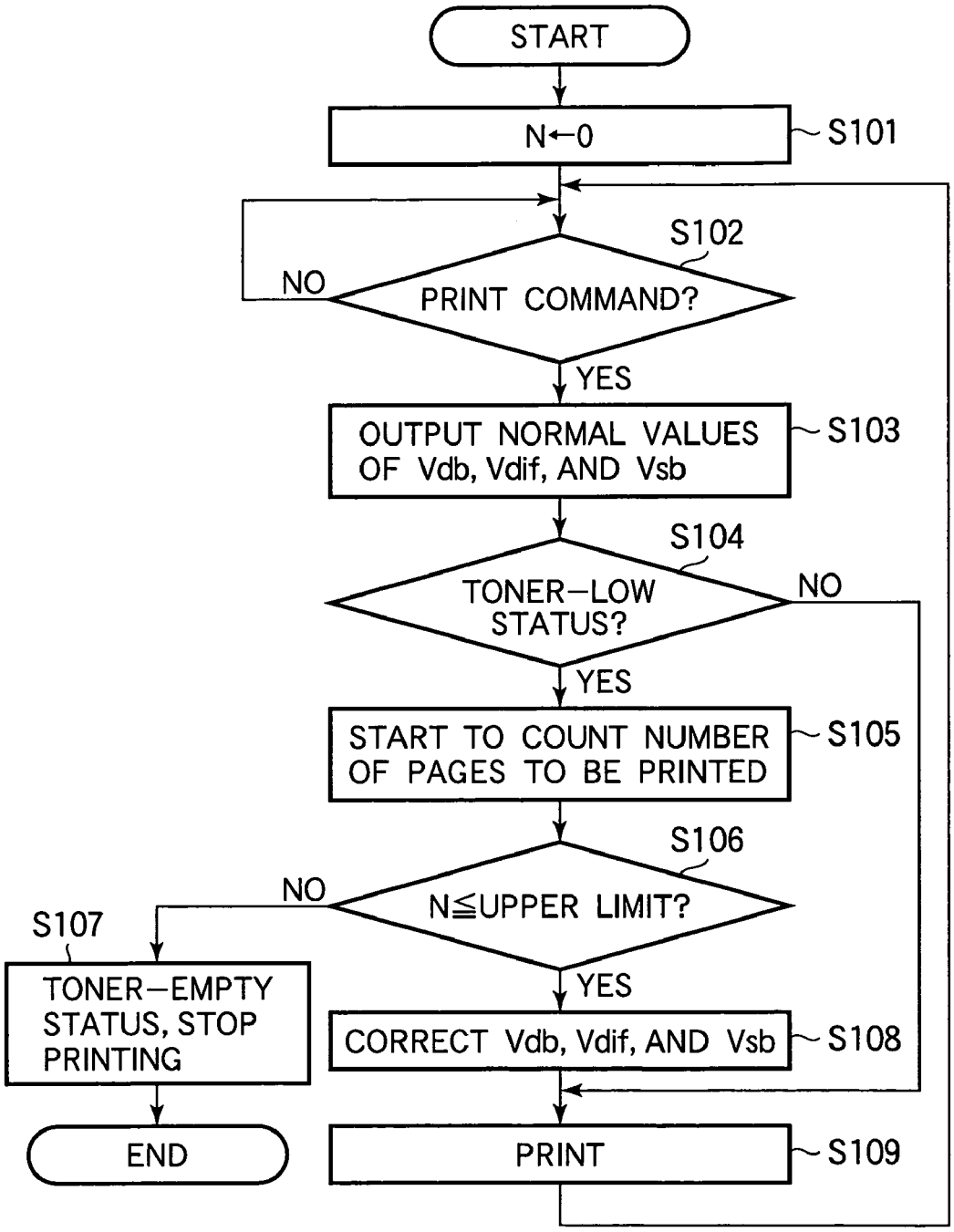
FIG. 12 is a flowchart illustrating the operation of the image forming apparatus.

FIG. 12 is a flowchart illustrating the operation of the image forming apparatus. The operation for correcting the Vdb and Vdif will be described with reference to FIG. 12. The flowchart assumes that the amount of toner held in the reservoir is initially larger than the tone low level.

Step S101: The central controller 130 (FIG. 5) resets the page counter 30*c* to "0" upon power-up of the image forming apparatus.

Step S102: The central controller 130 waits for a print command.

Step S103: In response to the print command, the Vdb and Vdif having their normal values are outputted. Thus, the supplying bias voltage Vsb is also determined accordingly.

Step S104: The timer 30*a* determines whether the remaining toner is below a predetermined value (i.e., toner-low status). Because a determination as to whether the "toner-low" status is reached can be made only when the detection bar 21 is moving, the check is made based on the detection signal DETR in the preceding print job. If the answer is NO at step S104, then the program jumps to step S109 where the high voltage power supply 32 provides the Vdb and Vsb, which is used in the preceding printing operation, to the developing roller 3 and supplying roller 4, respectively.

Step S105: If the answer is YES at step S104, the page counter 30*c* starts to count up the cumulative number of pages N. It should be noted that when the toner-low status occurs in the middle of the execution of a print job, the page counter 30*c* does not start counting.

Step S106: A check is made to determine whether the cumulative number of pages N is equal to or smaller than a predetermined value.

Step S107: If the answer is NO at step S106, it is determined that printing is not allowed due to exhaustion of toner. Then, the central controller 130 generates a "toner-empty" signal and a command to stop printing.

Step S108: If the answer is YES at step S106, the central controller 130 corrects the Vdb and Vdif. Here, either only the Vdb is decreased or the Vdb is decreased and Vdif is increased. The high voltage power supply 32 outputs a corrected Vdb and a corrected Vdif.

Step S109: Printing is performed. Upon completion of printing at S109, the program jumps back to step S102 where the program waits for the next print command. The high voltage power supply 32, voltage controller 30*b*, and central controller 130 constitute a voltage setting means.

As described above, when the toner-low status occurs, either only the Vdb is decreased or the Vdb is decreased and the Vdif is increased to prevent vague images that would otherwise occur after the toner-low status is detected. This ensures good printing quality. It should be noted that printing is not allowed when the remaining toner decreases to a level at which the correction of the Vdb and Vdif is no longer effective in preventing vague images. This prevents failure of printing due to occurrence of vague image, and waste of print paper accordingly.

{Replenishment of Toner}

The toner may be replenished when the toner is nearing exhaustion or after the toner detector 20 detects a toner-low status. Once a sufficient amount of toner has been replenished after the remaining amount of toner had reached the toner-low status, the high voltage power supply 32 does not output the Vdb and Vdif corrected under a toner-low status but the Vdb and Vdif having their normal values.

Figure 13:
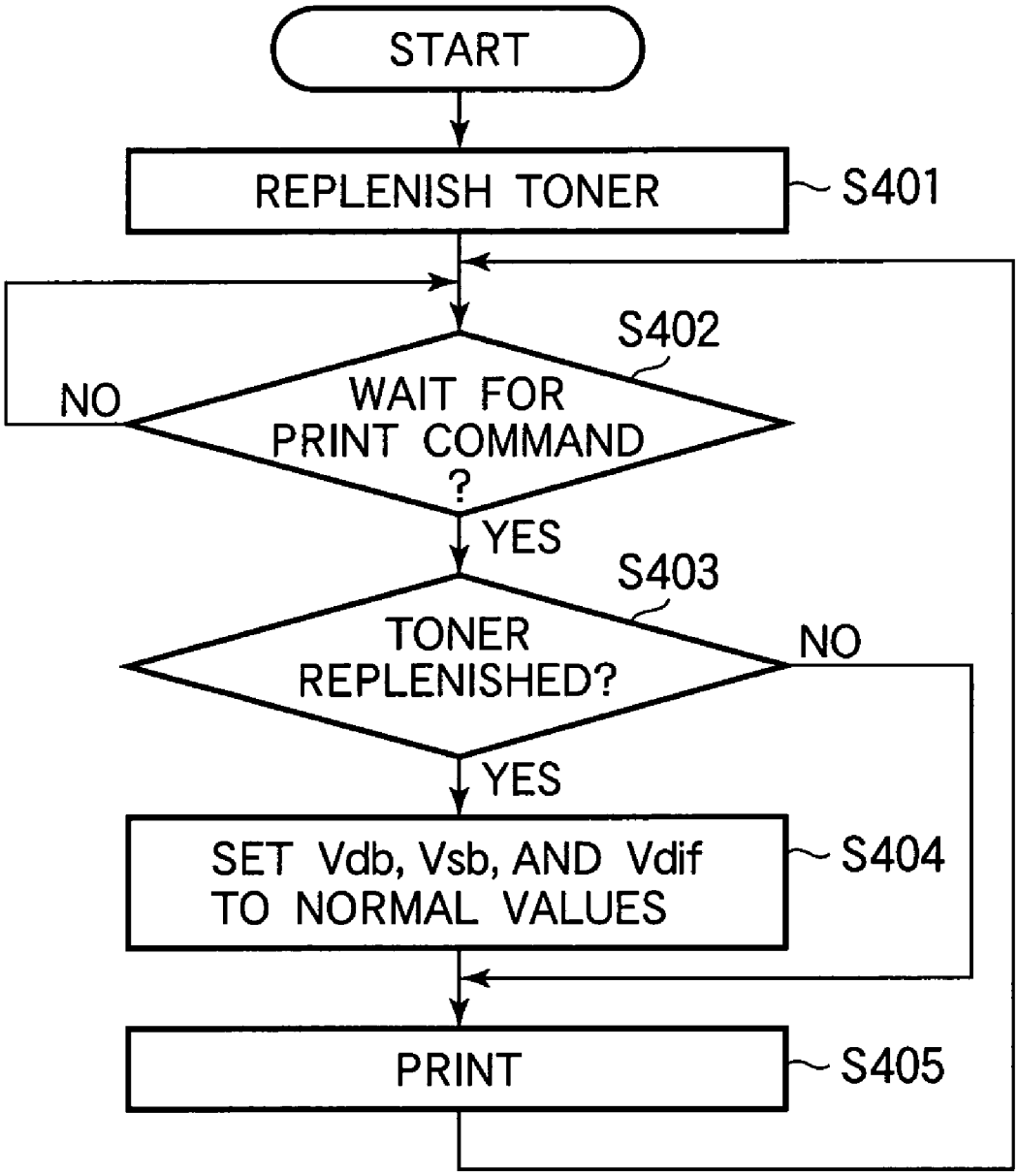
FIG. 13 is a flowchart illustrating the operation for returning the Vdb and Vdif from their corrected values to their normal values.

FIG. 13 is a flowchart illustrating the operation for returning the Vdb and Vdif from their corrected values to their normal values. The operation will be described with reference to FIG. 13.

Step S401: The toner-low status is sensed as a result of execution of the flowchart in FIG. 12. Then, the Vdb, Vsb and Vdif are corrected accordingly.

Step S402: The central controller 330 waits for a print command. Replenishment of the toner may occur while waiting for the print command. For example, the replenishment of toner is performed as follows:

A cover (not shown) of the image forming apparatus is first opened and then a toner cartridge (not shown) is replaced. As a result, a toner reservoir 10 is filled with toner 12. When the cover is opened and closed, the central controller 330 detects the ON/OFF statuses of a detection switch (not shown), and a toner detector 20 detects the remaining amount of toner in a toner reservoir 10. The information on-whether the toner reservoir 10 is no longer at the toner-low status is stored in the central controller 330.

Step S402: Upon receiving a print command, the program proceeds to step S403.

Step S403: The central controller 330 makes a decision to determine whether a sufficient amount of toner has been replenished. If the answer is YES, the program proceeds to step S404. If the answer is NO, then the program jumps to step S405.

Step S404: The controller 30*b* ceases correction of the Vdb, Vsb, and Vdif, and causes the high voltage power supply 32 to output the Vdb and Vdif having their normal values.

Step S405: Printing is performed.

The above described steps S402-S405 are executed when the cover of the image forming apparatus is closed after replenishment of the toner. After execution of steps S402-S405, the program goes back to the operation shown in FIG. 12. In this manner, the Vdb, Vsb, and Vdif are returned to their normal values.

As described above, whenever replenishment of toner is carried out, a check is made to determine whether the toner reservoir 10 is at the toner-low status. The result of the check is applied to the subsequent printing operation.

The correction of the Vdb and Vdif is ceased shortly after the toner-low status is resolved. Therefore, once the toner reservoir 10 holds a sufficient amount of toner again, no correction of Vdb and Vdif is made, thereby preventing consumption of toner more than necessary.

Second Embodiment

Figure 14:
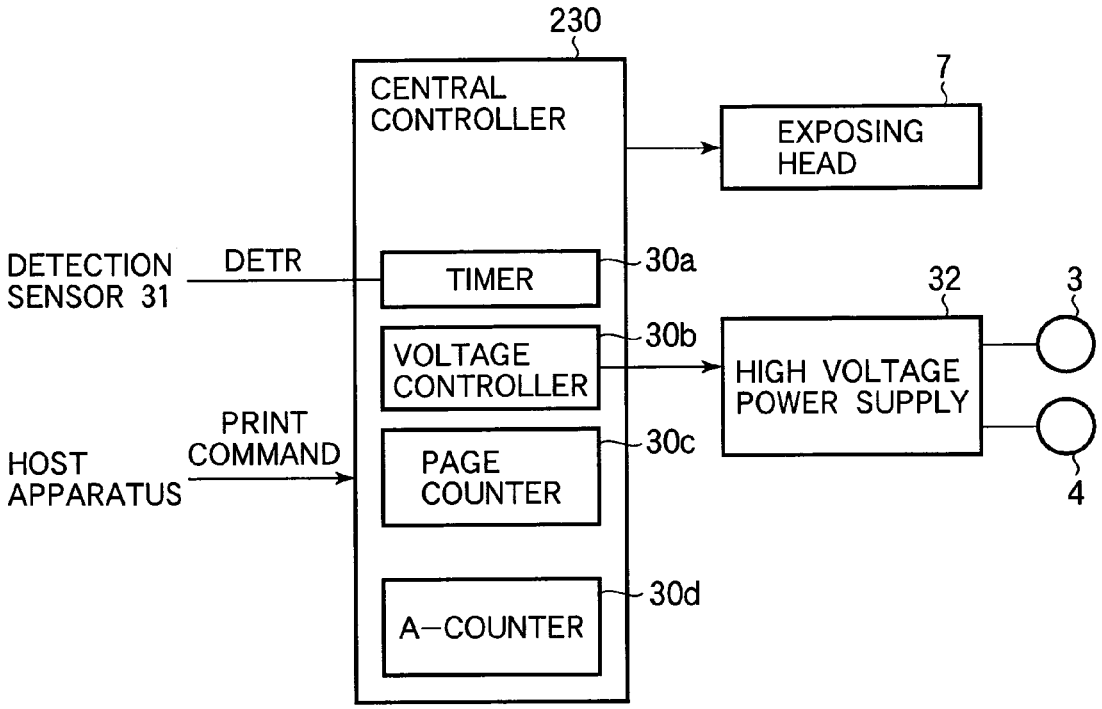
FIG. 14 is a block diagram illustrating a pertinent configuration of a control system of a second embodiment.

FIG. 14 is a block diagram illustrating a pertinent configuration of a control system of a second embodiment.

The control system of the second embodiment differs from that of the first embodiment in that a central controller 230 includes an A-counter 30*d* for counting the number of dots to be formed on a photoconductive drum 1 by an exposing head 7, the number of dots being counted after detection of the toner-low status and before remaining pages of the image data is printed. Elements similar to those of the control system of the first embodiment have been given the same reference numerals and their detailed description is omitted. A toner low detector 20 is the same as that (FIGS. 3A-3C) of the first embodiment. A print cartridge of the second embodiment is of the same configuration as that of the first embodiment shown in FIGS. 1-4. Thus, the following description will be made with reference to FIGS. 1-4 as required.

The central controller 230 includes a timer 30*a*, a voltage controller 30*b*, a page counter 30*c*, and the A-counter 30*d*. The timer 30*a* receives a detection signal DETR from a detection sensor 31 and determines the duration of the detection signal DETR. The voltage controller 30*b* controls high negative voltages applied to the developing roller 3 and a supplying roller 4. The page counter 30*c* counts the number of pages printed after detection of the toner-low status. Once the page counter has started to count, it continues to count until the toner low status is eliminated. After detection of the toner-low status, the A-counter 30*d* counts the number of dots to be printed on each page of a remaining portion of the print job (image data) before they are formed on the image bearing body 1 by the exposing head 7. Upon receiving the image data and control command from a host apparatus, the central controller 230 controls the sequence of overall operation of the image forming apparatus. The high voltage power supply 32 provides high negative voltages to the developing roller 3 and supplying roller 4 under the control of the voltage controller 30*b*.

In the first embodiment, when the toner-low occurs, a developing bias voltage Vdb supplied to a developing roller 3 and a voltage difference Vdif (=Vdb−Vsb) between the Vdb and a supplying bias voltage Vsb supplied to a supplying roller 4 are corrected unconditionally, so that only a limited number of pages N of print paper may be printed after detection of the toner-low status. In the second embodiment, upon a print command, a check is made to determine whether a print job contains at least one page of at least partially high density portion. The Vdb and Vdif are corrected only when the print job contains at least one page of at least partially high density portion.

A determination as to whether a print job contains a high density portion may be made as follows: When a toner detector 20 detects a toner-low status, the A-counter 30*d* starts to count the number of dots to be formed in each page of a remaining portion of image data (i.e., print job) on a page-by-page basis before the remaining portion of the image data is printed. The A-counter 30*d* is reset after each print job has been executed. The central controller 230 calculates a dot population density in each page of the print job is calculated based on the number of dots to be formed on the image bearing body 1. Then, the central controller 230 compares calculated dot population density with a reference value of dot population density.

Dot population density refers to the ratio of the number of dots that should be printed in a printable area in a page of image data to a total number of dots printable in the page. For example, the dot population density is 100% for a solid pattern and the dot population density is 0% for a white pattern. If the dot population density is high (e.g., 80%), it is determined that the print job contains a page of high density portion, and the Vdb and Vdif are corrected before portion.

As described above, the Vdb and Vdif are corrected only when the remaining amount of toner decreases below a predetermined level (i.e., toner-low status) and a print job contains a page of a high density portion, thereby preventing occurrence of vague image. However, if the image forming apparatus continues to print after detection of the toner-low status, the remaining amount of toner will be completely exhausted soon or later. Thus, just as in the first embodiment, when the page counter 30*c* has counted up to a predetermined value, printing is prohibited.

Figure 15:
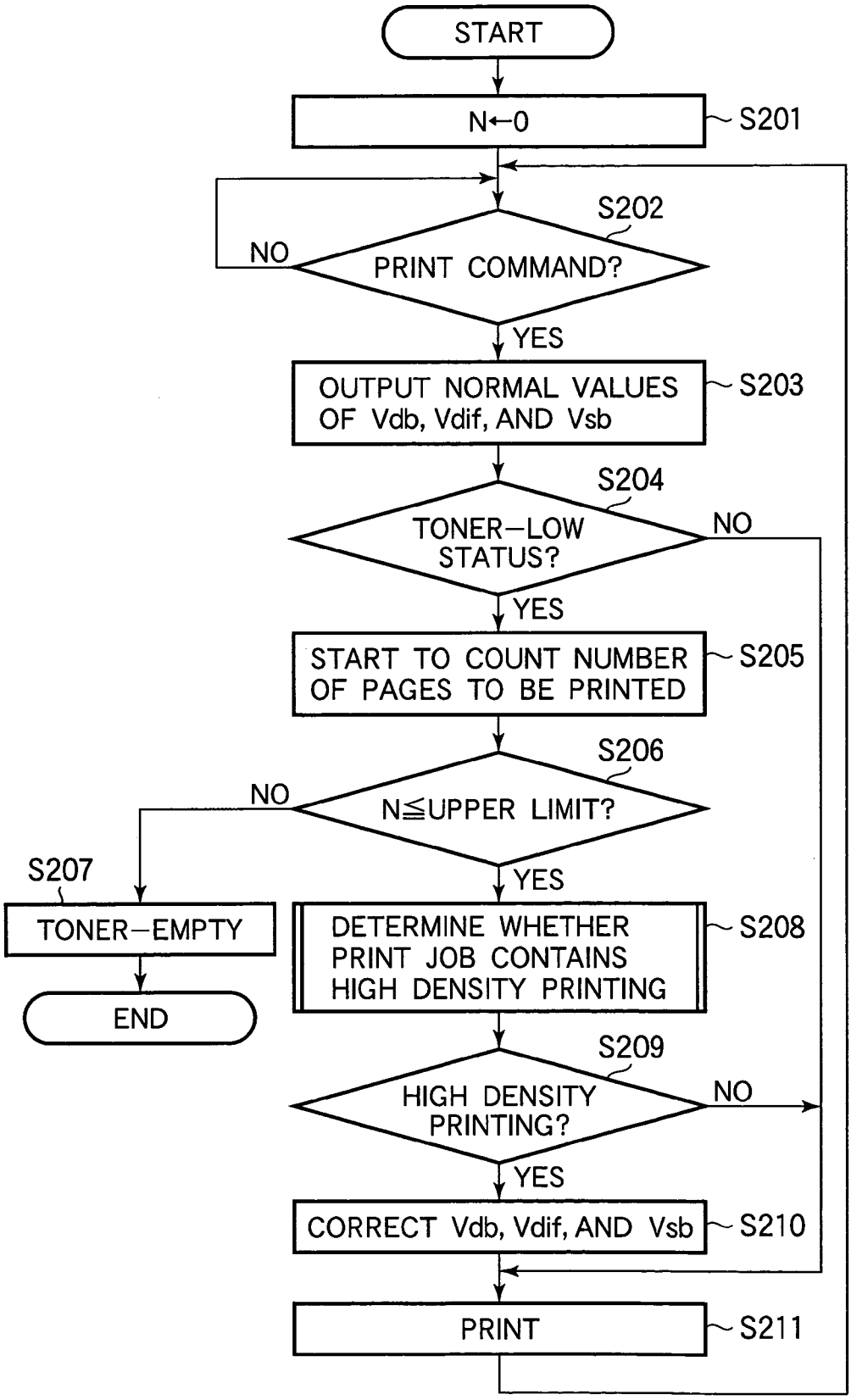
FIG. 15 is a flowchart illustrating the operation of the image forming apparatus of the second embodiment.

FIG. 15 is a flowchart illustrating the operation of the image forming apparatus of the second embodiment. The operation for correcting Vdb and Vdif will be described with reference to FIG. 15.

Steps S201 to S207 are actually the same as steps S101 to S107 shown in FIG. 12.

Step S201: The central controller 130 (FIG. 5) resets the page counter 30*c* to "0" upon power-up of the image forming apparatus.

Step S202: The central controller 130 waits for a print command.

Step S203: In response to the print command, the voltage controller 30*b* causes the high voltage power supply 32 to output the Vdb and Vdif of the normal values. Thus, the supplying bias voltage Vsb is also determined accordingly.

Step S204: The timer 30*a* determines whether the remaining toner is below a predetermined value (i.e., toner-low status). Because "toner-low status" may be determined based only on the motion of the detection bar 21, the check is made based on the detection result in the preceding printing operation. If the answer is NO at step S204, then the program jumps to step S211 where the high voltage power supply 32 provides the Vdb and Vsb used in the preceding printing operation to the developing roller 3 and supplying roller 4, respectively, and then printing is performed.

Step S205: If the answer is YES at step S204, the page counter 30*c* counts the cumulative number of pages N. It should be noted that when the toner-low status occurs in the middle of the execution of a print job, the page counter 30*c* does not start counting.

Step S206: A check is made to determine whether the cumulative number of pages N is equal to or smaller than a predetermined value.

Step S207: If the answer is NO at step S206, it is determined that printing is not possible due to exhaustion of toner. Then, the central controller 130 outputs a toner-empty signal and a command to stop printing.

Step S208: If the answer is YES at step S206, the A-counter 30*d* counts the number of dots formed in each page of the remaining portion of the print job, and a check is made to determine whether the remaining portion of the print job contains a page of high printing density.

Step S209: The central controller 230 makes a decision to determine whether the print job contains at least one page of a high density portion. If the answer is YES at step S209, the program proceeds to step S210 where the high voltage power supply 32 outputs the corrected Vdb, Vsb, and Vdif. If the answer is NO at step S209, the program jumps to step S211 where printing is performed.

Step S210: If the flag A indicates that the print job contains at least one page of at least partially high density portion (YES at S209), the Vdb and Vdif set at S203 are corrected by a predetermined correction value. The correction is achieved either by decreasing the Vdb, or by decreasing the Vdb and increasing the Vdif.

Step S211: The high voltage power supply 32 outputs the corrected Vdb and Vdif and then printing is performed. Then, the program loops back to step S202 where the central controller 130 waits for a print command.

Figure 16:
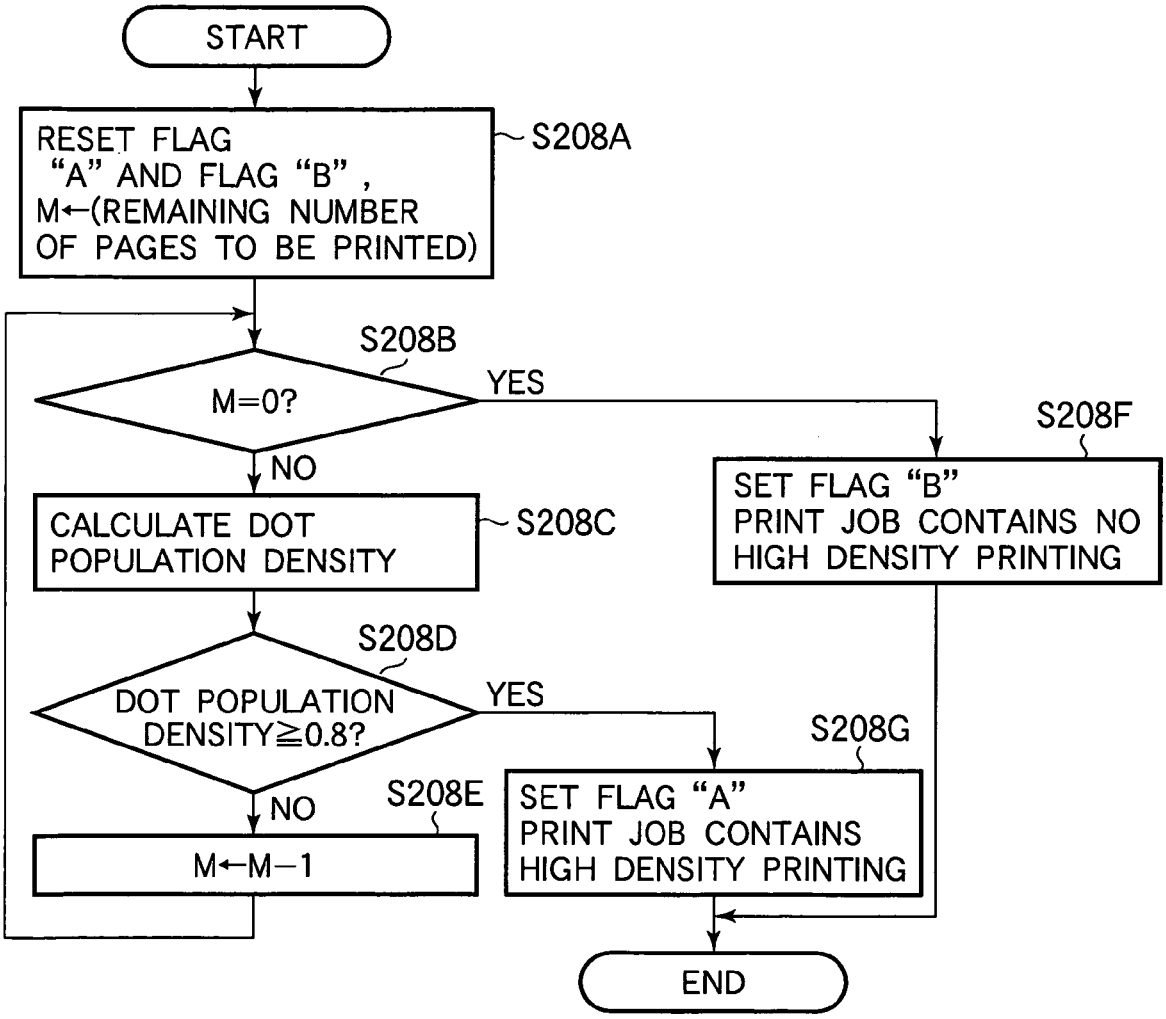
FIG. 16 is a flowchart illustrating the details of the process at step S208 in FIG. 15.

FIG. 16 is a flowchart illustrating the details of the process at step S208 in FIG. 15 in which the central controller 230 calculates a dot population density to determine whether a print job contains a page of high density portion.

Step S208A: The total number of pages M to be printed is detected from the print job and is stored into a memory, and flags A and B are reset.

Step S208B: The central controller 230 makes a decision to determine whether calculation of dot population density has been made for all of the pages M to be printed. If the answer is YES, then the program proceeds to step S208F.

Step S208C: If the answer is NO at step 208B, then the central controller 230 calculates the dot population density for the next page.

Step S208D: The central controller 230 makes a decision to determine whether the calculated dot population density is equal to or greater than 80%.

Step S208E: If the answer is YES at step S208D, the flag A is set, which indicates that the print job contains a page of high density portion.

Step S208F: If the answer is NO at step S208D, the number of pages M is decremented by "1" and then the program loops back to step S208B. In other words, steps S208B-S208E are repeated as long as the number of pages M is not "0."

Step S208F: The flag B is set which indicate that the remaining portion of the print job does not contain a page of at least partially high density portion, and the program ends.

As described above, the process at steps S208A-208G is carried out to determine whether the print job contains at least one page that requires high density portion.

In the second embodiment, it is determined at S209 that if a page has a dot population density equal to or greater than 80%, then that page is of high density printing. This criterion is only exemplary, and may be other values than 80%.

In the second embodiment, if a print job contains at least one page of high density portion, then the print job is executed with the corrected Vdb and Vdif for all pages. Alternatively, the correction of the Vdb and Vdif may be made such that only a page(s) of high density print may be printed with the corrected Vdb and Vdif.

As described above, when "toner-low status" is sensed, a check is made to determine whether the remaining pages of a print job after detection of the toner-low status contains a page of high density portion. Then, the correction of output voltages of the high voltage power supply 32 is made either by decreasing the Vdb, or by decreasing the Vdb and increasing the Vdif only when the image data (i.e., print job) contains a page of an at least partially high density portion, thereby preventing vague images that would otherwise occur if the amount of toner remaining in a toner reservoir 10 is in the toner-low status. If the amount of toner remaining in the toner reservoir 10 is too small such that the correction of the Vdb and Vdif is no longer effective in preventing vague images, then printing is not performed, thereby preventing failure of printing with vague images as well as waste of print paper.

The toner may be replenished when the toner is nearing exhaustion or after the toner detector 20 detects a toner-low status. The operation of the apparatus is the same as that described with reference to FIG. 13 in the first embodiment. The detailed description is omitted. After execution of steps S402-S405 shown in FIG. 13, the program goes back to the operation shown in FIG. 15.

Third Embodiment

A third embodiment is characterized in the operation of the apparatus for printing a following print job of two consecutive print jobs, assuming that a toner-low status is detected while a preceding print job of two consecutive print jobs is being executed but a toner reservoir 10 has not reached a toner-empty status yet after the printing of the preceding print job has been completed.

Figure 17:
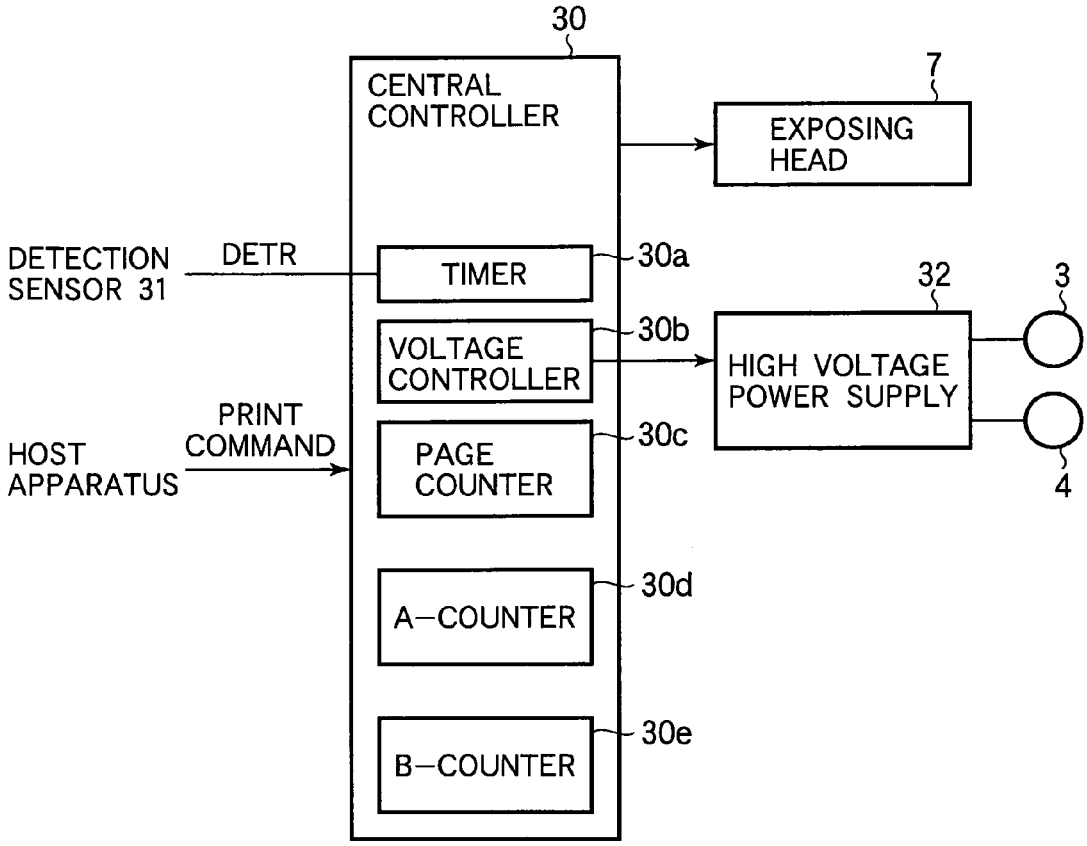
FIG. 17 is a block diagram illustrating a pertinent portion of a control system of a third embodiment.

FIG. 17 is a block diagram illustrating a pertinent portion of a control system of a third embodiment.

The control system of the third embodiment differs from those of the first and second embodiments in that a controller 330 includes a B-counter 30*e*. The B-counter 30*e* counts the cumulative number of dots that has been formed by an exposing head 7 after a toner reservoir 10 has reached a toner-low status. Elements similar to those of the control systems of the first embodiment (FIG. 5) and second embodiment (FIG. 14) have been given the same reference numerals, and their description is omitted. A toner low detector 20 is the same as that (FIGS. 3A-3C) of the first embodiment. A print cartridge of the third embodiment is of the same configuration as that of the first embodiment shown in FIGS. 1-4. Thus, the following description will be made with reference to FIGS. 1-4 as required.

The controller 330 includes a timer 30*a*, a voltage controller 30*b*, a page counter 30*c*, an A-counter 30*d*, and the B-counter 30*e*. The timer 30*a* receives a detection signal DETR from a detection sensor 31, and determines the duration of the detection signal DETR. The voltage controller 30*b* controls high negative voltages Vdb and Vsb that should be applied to a developing roller 3 and a supplying roller 4, respectively. The page counter 30*c* counts the number of pages printed after a toner detector 31 (FIGS. 3A-3C) detects the toner-low status. Once the page counter has started to count, it continues to count until the toner low status is eliminated. The A-counter 30*d* counts the number of dots that should be formed on a photoconductive drum 1 by the exposing head 7, the number of dots being counted prior to execution of the print job. Upon receiving the image data (i.e., print job) and control command from a host apparatus, the controller 330 controls the sequence of the overall operation of the image forming apparatus. A high voltage power supply 32 provides high negative voltages Vdb and Vsb to the developing roller 3 and the supplying roller 4, respectively. The B-counter 30*e* counts the number of dots formed on the photoconductive drum after the toner-low status is detected.

In the third embodiment, an upper limit REQ of the amount of toner is set which may be consumed after a "toner-low" status has been sensed. When the sum of the amount of toner required for printing a remaining portion of a preceding print job of two consecutive print jobs after detection of the toner-low status and the amount of toner required for printing a following print job of the two consecutive print jobs exceeds the upper limit, the Vdb and Vdif for the following print job are corrected such that no vague images occur during execution of the following print job. The Vdif is the difference between the Vdb and Vsb, i.e., Vdif=Vdb−Vsb. It is to be noted that correction of the Vdb and Vdif is not made for the remaining portion of the preceding print job prior even if a toner-low status is detected in the middle of printing.

Assume that the toner-low status is detected while a preceding print job of two consecutive print jobs is being executed but a toner reservoir 10 has not reached a toner-empty status yet after the printing of the preceding print job has been completed.

The dot-after-toner-low counter 30*e* counts the number of dots printed after the toner-low status is reached. Based on the count of the dot-after-toner-low counter 30*e*, the central controller 330 calculates an amount of toner CQ actually consumed in printing the preceding print job after a toner detector 20 has detected the toner-low status. The amount of toner CQ is the product of the count of the dot-after-toner-low counter 30*e* and an amount of toner to be consumed per dot.

Then, for a following print job of the two consecutive print jobs, the central controller 330 calculates an amount of toner AQ required for printing the following print job. The amount of toner AQ is calculated based on the count of the A-counter 30*d* before execution of the following print job.

Then, if the sum of the amounts CQ and AQ exceeds a predetermined value, i.e., upper limit REQ, correction of the Vdb and Vdif is made for the following print job prior to execution of the following print job.

As described above, if the sum of the amounts CQ and AQ exceeds the predetermined value REQ, the Vdb and Vdif for the following print job are corrected so that the following print job may be executed for at least a limited number of pages. In this manner, occurrence of vague images may be prevented. If the number of printed pages of the following print job reaches the limited number of pages, then the printing of the following print job is interrupted.

Figure 18:
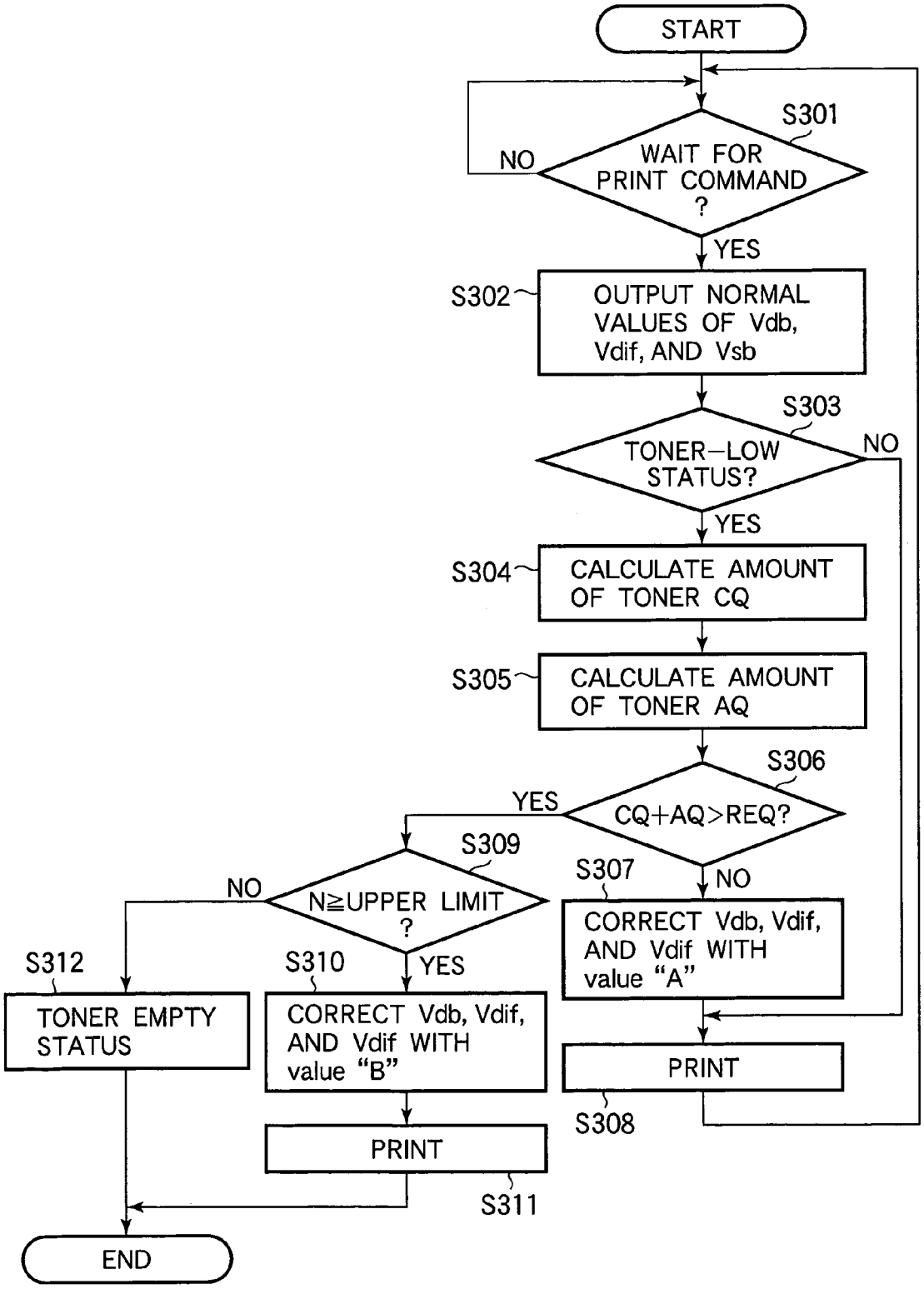
FIG. 18 is a flowchart illustrating the operation of the image forming apparatus of the third embodiment.

FIG. 18 is a flowchart illustrating the operation of the image forming apparatus of the third embodiment. The operation for correcting the Vdb and Vdif in a following print job of two consecutive print jobs will be described with reference to FIG. 18.

Step S301: The central controller 330 waits for a print command.

Step S302: Upon receiving the print command, the voltage controller 30*b* causes the high voltage power supply 32 to output the Vdb and Vdif having their normal values. Thus, the supplying bias voltage Vsb is also determined accordingly.

Step S303: The timer 30*a* determines whether the amount of the toner remaining in the toner reservoir 10 is below a predetermined value (i.e., toner-low status). A determination as to whether a toner reservoir 10 is at the toner-low status may be made based only on the motion of the detection bar 21. Thus, the check is made based on the detection result in the preceding print job. If the answer is NO at step S303, then the program jumps to step S308 where the high voltage power supply 32 provides the Vdb and Vsb having their normal values, which were set at step S302, to the developing roller 3, and then printing is performed.

Step S304: If the answer is YES at step S303, the central controller 330 calculates the amount of toner CQ that has been consumed in the preceding print job since the toner-low status was sensed.

Step S305: The central controller 330 calculates the amount of toner AQ required for executing the current print job.

Step S306: The central controller 330 makes a decision to determine whether the sum of the amounts CQ and AQ is equal to or greater than a predetermined value REQ. If the answer is YES at step S306, the program proceeds to step S309. If the answer is NO, then the program proceeds to step S307.

Step S307: The Vdb and Vdif are corrected with a predetermined correction value (level) "A".

Step S308: printing of the following print job is performed. After the execution of S308, the program jumps back to step S301.

Step S309: If the answer is YES at step S306, i.e., the sum of the amounts of toner CQ and AQ exceeds the upper limit REQ, a check is made to determine whether the number of pages n of image data of the currently executed print job has reached a predetermined value.

Step S310: If the answer is YES, then the Vdb and Vdif are corrected with a predetermined correction value (level) "B" larger than the correction value "A". If the answer is NO, it is determined that further printing is not allowed due to an insufficient amount of toner remaining in the toner reservoir 10, and the program proceeds to step S312.

Step S311: The high voltage power supply 32 outputs the corrected Vdb and Vdif, and the printing of the following print job is performed.

Step S312: If the answer is NO at step S309, i.e., the number of pages n has reached the predetermined value n, it is determined that the remaining amount of toner is not sufficient for further printing. The central controller 330 outputs a message "toner empty" and a command to stop printing.

As described above, when the remaining toner is approaching "toner empty status" and the sum of the amounts CQ and AQ exceeds a predetermined value REQ, printing of only a predetermined number of pages n of a print job is allowed with the corrected Vdb and Vdif by the correction value "B", thereby preventing vague images that would otherwise occur due to an insufficient amount of toner remaining in the toner reservoir 10. In addition, when the remaining toner is approaching "toner empty status" but the sum of the amounts CQ and AQ does not exceed a predetermined value REQ, printing of the current print job is allowed with the corrected Vdb and Vdif by the correction value "A", thereby preventing vague images that would otherwise occur due to an insufficient amount of toner.

The toner may be replenished when the toner is nearing exhaustion or after the toner detector 20 detects a toner-low status. The operation of the apparatus is the same as that described with reference to FIG. 13 in the first embodiment. The detailed description is omitted. After execution of steps S402-S405 shown in FIG. 13, the program goes back to the operation shown in FIG. 18.

While the present invention has been described with respect to a printer, the invention may also be applied to electrophotographic facsimile machines, copying machines, and multi function printers. The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

an exposing section that illuminates a surface of a charged image bearing body to form an electrostatic latent image;

a developing member developing the electrostatic latent image;

a developer material reservoir;

a supplying member that supplies developer material to the developing member from the developer material reservoir;

a voltage supply that applies a voltage to the developing member and the supplying member;

a controller that controls the voltage supply to output the voltage; and a detector that generates a detection signal indicative of an amount of developer material remaining in the developer material reservoir;

wherein the controller performs voltage correction in which the voltage supply outputs the voltage in accordance with the detection signal;

wherein when the detection signal indicates that the amount of the developer material is equal to or higher than a reference value, the controller controls the voltage supply to output a first voltage to the developing member;

wherein after the detection signal indicates that the amount of the developer material is lower than the reference value, the controller controls the voltage supply to output a second voltage to the developing member, the second voltage having a smaller absolute value than the first voltage;

wherein when the detection signal indicates that the amount of the developer material is equal to or higher than the reference value, the controller controls the voltage supply to output a third voltage to the supplying member; and wherein when the detection signal indicates that the amount of the developer material is lower than the reference value, the controller controls the voltage supply to output a fourth voltage to the supplying member, fourth voltage having a larger absolute value than the third voltage.

2. The image forming apparatus according to claim 1, wherein the image forming apparatus further comprises:

a counter that counts a number of dots that should be formed on the image bearing body after the detection signal has become lower than the reference value, the number of dots being counted prior to printing the dots; and wherein the controller makes a decision as to whether the second voltage should be output to the developing member based at least in part on the number of dots counted by the counter.

3. The image forming apparatus according to claim 2, further comprising a page counter that counts a number of pages printed after the detection signal indicates that the amount of the developer material is lower than the reference value;

wherein when the number of pages exceeds a predetermined value, the page counter outputs a command to prohibit printing.

4. The image forming apparatus according to claim 2, wherein after the detection signal indicates that the amount of the developer material has become lower than the reference value, if the detection signal again indicates that the amount of the developer material is above the reference value, the controller controls the voltage supply to output the first voltage to the developing member.

5. The image forming apparatus according to claim 2, further comprising a dot population density calculation section that calculates a ratio of the number of dots that should be printed in a printable area in a page of the print job to a total number of dots printable in the printable area;

wherein when the ratio exceeds a reference value, the controller controls the voltage supply to output the second voltage.

6. The image forming apparatus according to claim 1, wherein the supplying member is a toner supplying roller.

7. The image forming apparatus according to claim 6, wherein the toner supplying roller is formed of a metal shaft and a foamed urethane rubber material.

8. The image forming apparatus according to claim 1, further comprising a page counter that counts a number of pages printed after the detection signal indicates that the amount of the developer material is below the reference value;

wherein when the number of pages exceeds a predetermined value, the page counter outputs a command to prohibit printing.

9. The image forming apparatus according to claim 1, further comprising a page counter that counts a number of pages printed after the detection signal indicates that the amount of the developer material is below the reference value;

wherein when the number of pages exceeds a predetermined value, the page counter outputs a command to prohibit printing.

10. The image forming apparatus according to claim 1, wherein after the detection signal indicates that the amount of the developer material has become below the reference value, if the detection signal again indicates that the amount of the developer material is above the reference value, the controller controls the voltage supply to switch from the second voltage to the first voltage and to switch from the fourth voltage to the third voltage.

11. An image forming apparatus, comprising:

an exposing section that illuminates a surface of a charged image bearing body to form an electrostatic latent image; a developing member developing the electrostatic latent image;

a developer material reservoir;

a supplying member that supplies a developer material from the developer material reservoir to the developing member;

a voltage supply that applies voltage to the developing member and voltage to the supplying member;

a controller that controls the voltage supply to output the voltage to the developing member and the voltage to the supplying member; and a detector that generates a detection signal indicative of an amount of developer material remaining in the developer material reservoir;

a page counter that counts a number of pages printed after the detection signal indicates that the amount of the developer material is below the reference value;

wherein when the number of pages exceeds a predetermined value, the page counter outputs a command to prohibit printing;

wherein the controller performs voltage correction in which the voltage supply outputs the voltage to the developing member and the voltage to the supplying member in accordance with the detection signal;

wherein when the detection signal indicates that the amount of the developer material is equal to or higher than a reference value, the controller controls the voltage supply to output a first voltage to the developing member; and wherein after the detection signal indicates that the amount of the developer material is lower than the reference value, the controller controls the voltage supply to output a second voltage to the developing member, the second voltage having a smaller absolute value than the first voltage such that the absolute value of a difference in voltage between the developing member and the supplying member increases.

12. The image forming apparatus according to claim 11, wherein after the detection signal indicates that the amount of the developer material has become below the reference value, if the detection signal again indicates that the amount of the developer material is above the reference value, the controller controls the voltage supply to switch the voltage applied to the developing member from the second voltage to the first voltage.

13. An image forming apparatus, comprising:

an image bearing body;

an exposing section that illuminates a surface of the image bearing body to form an electrostatic latent image;

a developing member facing the image bearing body and developing the electrostatic latent image;

a developer material reservoir;

a supplying member that supplies a developer material from the developer material reservoir to the developing member;

a voltage supply that applies voltage to the developing member and voltage to the supplying member;

a controller that controls the voltage supply to output the voltage to the developing member and the voltage to the supplying member; and a detector that generates a detection signal indicative of an amount of the developer material remaining in the developer material reservoir;

wherein if the detector signal indicates that the amount of developer material is above a reference valve, the controller controls the voltage supply to apply a first voltage to the developing member; and wherein if the detection signal indicates that the amount of the developer material is below the reference value, the controller controls the voltage supply to change at least the voltage applied to the developing member such that the first voltage is changed to a second voltage having an absolute value smaller than that of the first voltage, and such that the absolute value of a difference in voltage between the developing member and the supplying member increases.

14. The image forming apparatus according to claim 13, further comprising a layer forming member configured to form a layer of the developer material on the developing member.

15. The image forming apparatus according to claim 14, wherein the second voltage has an absolute value smaller than 160 volts.

16. The image forming apparatus according to claim 14, wherein the layer forming member is a developing blade.

17. The image forming apparatus according to claim 14, wherein after the detection signal indicates that the amount of the developer material has become below the reference value, if the detection signal thereafter again indicates that the amount of the developer material is above the reference value, the controller controls the voltage supply to switch from the second voltage to the first voltage.

18. The image forming apparatus according to claim 13 wherein the developing member is a developing roller.

19. The image forming apparatus according to claim 18, wherein the supplying member is a developer material supplying roller.

20. The image forming apparatus according to claim 19, wherein the developer supplying roller includes a metal shaft and a foamed urethane rubber material.

21. The image forming apparatus according to claim 18, wherein the developing roller includes a metal shaft and a semiconductive urethane rubber material.

22. The image forming apparatus according to claim 18, wherein the second voltage has an absolute value smaller than 160 volts.

23. The image forming apparatus according to claim 18, wherein after the detection signal indicates that the amount of the developer material has become below the reference value, if the detection signal thereafter again indicates that the amount of the developer material is above the reference value, the controller controls the voltage supply to switch from the second voltage to the first voltage.

24. The image forming apparatus according to claim 13, wherein after the detection signal indicates that the amount of the developer material has become below the reference value, if the detection signal thereafter again indicates that the amount of the developer material is above the reference value, the controller controls the voltage supply to switch from the second voltage to the first voltage.

25. The image forming apparatus according to the claim 13, wherein the controller controls the voltage supply so that the voltage applied to the supplying member remains unchanged.

26. The image forming apparatus according to the claim 13, wherein the controller controls the voltage supply so that the voltage applied to the supplying member and the voltage applied to the developing member are both changed.

27. The image forming apparatus according to claim 13, wherein the second voltage has an absolute value smaller than 160 volts.

* * * * *